US005505593A

United States Patent [19]

Hartley et al.

[11] Patent Number: 5,505,593

[45] Date of Patent: Apr. 9, 1996

[54] RECIPROCABLE DEVICE WITH SWITCHING MECHANISM

[75] Inventors: E. Dale Hartley, Malibu; F. Scott Hartley, Camarillo, both of Calif.

[73] Assignee: Shurflo Pump Manufacturing Co., Santa Ana, Calif.

[21] Appl. No.: 135,791

[22] Filed: Oct. 13, 1993

[51] Int. Cl.[6] ..... F01L 31/02; F04B 17/00

[52] U.S. Cl. ..... 417/393; 417/521; 91/346; 91/341 R

[58] Field of Search ..... 417/393, 401, 417/521; 91/344, 346, 327, 341 R

[56] References Cited

U.S. PATENT DOCUMENTS

| | | | |
|---|---|---|---|
| 3,768,932 | 10/1973 | Svercl et al. . | |
| 4,172,698 | 10/1979 | Hinz et al. | 91/346 |
| 4,348,161 | 9/1982 | Shibata . | |
| 4,354,806 | 10/1982 | McMillin et al. . | |
| 4,610,192 | 9/1986 | Hartley et al. . | |
| 4,684,332 | 8/1987 | Hartley et al. . | |
| 4,827,831 | 5/1989 | Hartley et al. . | |
| 4,827,832 | 5/1989 | Hartley et al. . | |
| 4,836,924 | 6/1989 | Solomon . | |
| 4,923,168 | 5/1990 | Murata et al. | 91/346 |
| 5,000,845 | 3/1991 | Solomon . | |
| 5,009,777 | 4/1991 | Solomon . | |
| 5,120,202 | 6/1992 | Murata et al. | 417/401 |
| 5,244,361 | 9/1993 | Solomon . | |

FOREIGN PATENT DOCUMENTS

| | | |
|---|---|---|
| 0109746 | 5/1984 | European Pat. Off. . |

*Primary Examiner*—Richard A. Bertsch
*Assistant Examiner*—William Wicker

[57] ABSTRACT

A reciprocable device comprising a reciprocable member mounted for reciprocating movement within a chamber and a valve system for controlling the supply of fluid under pressure to the reciprocable member to bring about reciprocation of the member. The valve system comprises a spool valve, a coupling mechanism for joining the reciprocable member and the spool valve, and a bistable spring, which is actuated by the reciprocable member, for driving the spool valve through the coupling mechanism.

17 Claims, 4 Drawing Sheets

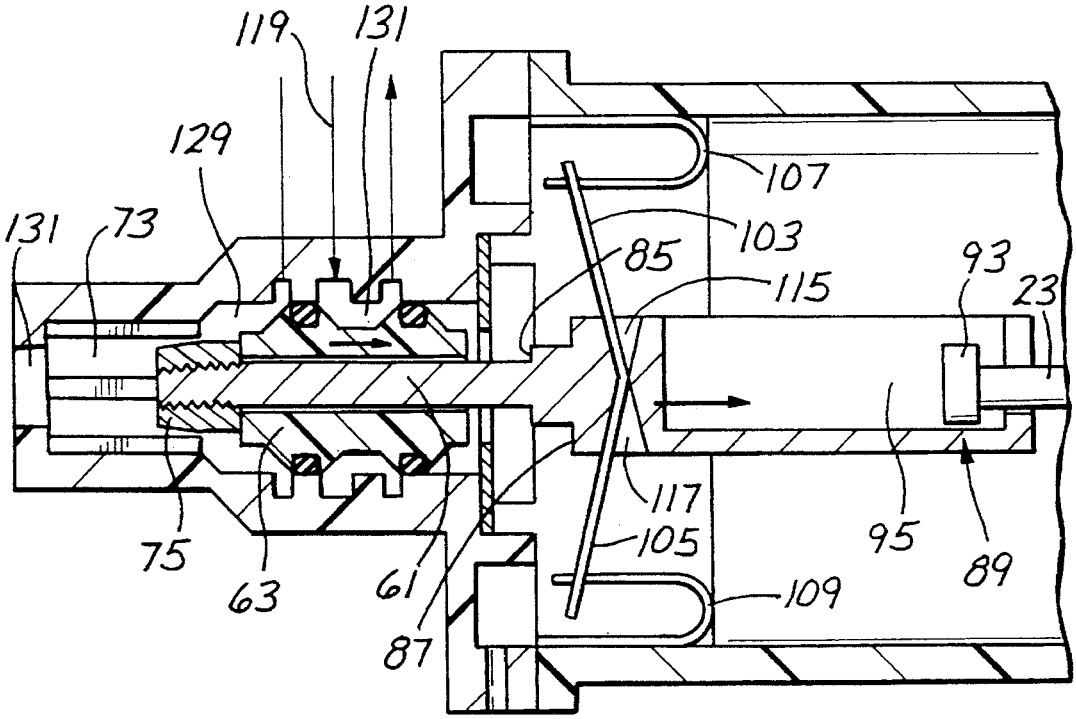
Fig. 3
Fig. 5
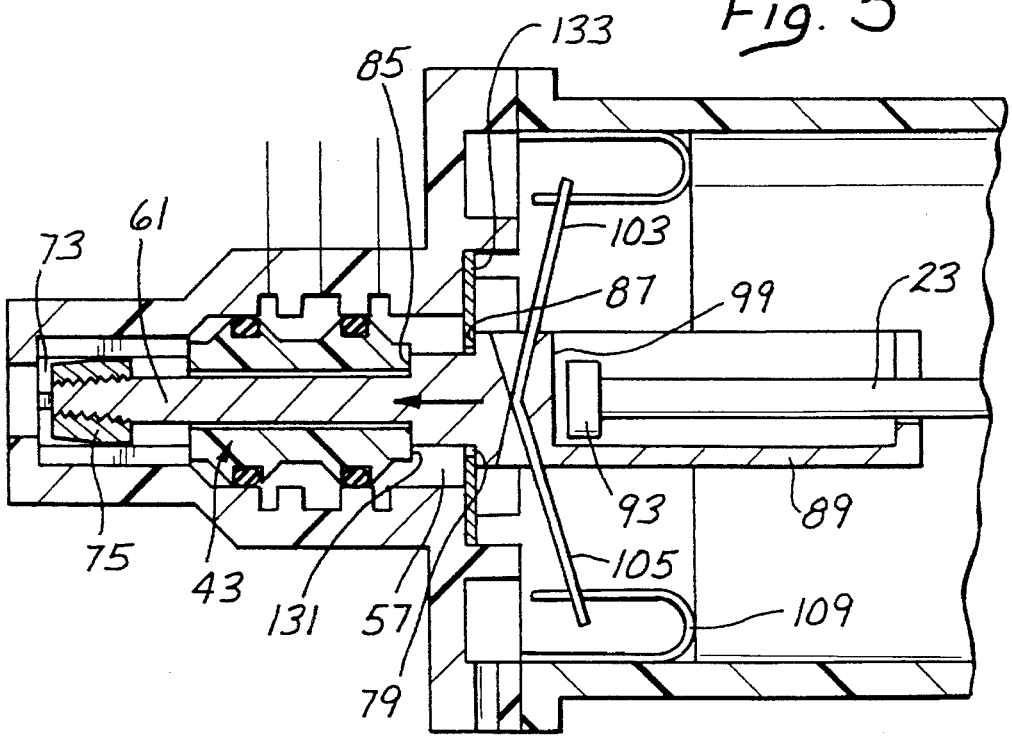

RECIPROCABLE DEVICE WITH SWITCHING MECHANISM

BACKGROUND OF THE INVENTION

This invention relates to reciprocable devices, and more particularly to a reciprocable device having an improved valving system for ensuring dependable switching of the reciprocable member travel direction during operation.

Reciprocable devices typically include a reciprocable member which reciprocates to perform a useful function, such as pumping a flowable material, compressing a gas, metering a fluid or providing a reciprocating output for other purposes. A driving fluid under pressure, which may be either a liquid or a gas, is commonly used to reciprocate the reciprocable member. For example, the reciprocable member may be a piston having first and second faces which are alternately exposable to driving fluid under pressure and to exhaust.

A valve or valving system is provided for controlling the exposure of the piston faces to the pressurized driving fluid and to exhaust. In order for the valve system to perform its function, it typically includes one or more valve elements which must be moved periodically from one position to another to bring about reciprocation of the piston. Movement of the reciprocable member can be used to control movement of the valve elements.

Reciprocating devices of the type described are shown, for example, in U.S. Pat. No. 4,610,192 to Hartley et al. The construction disclosed therein employs a bistable toggle mechanism which is driven just over center by energy from the piston and then driven by stored spring energy. The toggle action reverses the pressure and exhaust valves to bring about a reversal of movement of the reciprocable member. The valves in this prior art system are fluid pressure biased.

SUMMARY OF THE INVENTION

This invention provides a valving system for a reciprocable device of the type discussed, which is even easier to switch over, does not require a strong spring force to actuate, and provides for a mechanical backup in case of a valve jam, so that valve switchover and consequent dependable operation of the reciprocable device is assured.

The invention provides a reciprocable device, in which a spool valve movable between first and second positions is employed for controlling the supply and exhaust of the driving fluid under pressure to and from the first and second driving faces of a reciprocable member. The reciprocable device also includes a bistable spring device having first and second states and a neutral position therebetween and a mechanism for drivingly coupling the reciprocable member and the bistable spring device so that the reciprocable member can move the bistable spring device from one of its states through the neutral position. The resilience of the bistable spring device at least assists in moving the bistable spring device from its neutral position to the other state thereof. The bistable spring device is coupled to the spool valve so that movement of the bistable spring device to the other state at least assists in driving the spool valve from one of the first and second positions to the other one thereof.

With this invention, it is the driving fluid under pressure which drives the reciprocable member in both directions. Preferably the reciprocable member is driven in both directions solely by the fluid under pressure. Although one or more drive springs can be employed to assist in driving the reciprocable member, none is required.

A spool valve, and particularly a spool valve having the features described below, is relatively easy to move. This coupled with the lack of any need for a drive spring which would be compressed and therefore take energy from the system as the reciprocable member moves in one direction, reduce the likelihood of stalling due to failure of the valving system to switch over.

Another important feature of the invention is that a mechanical backup is provided if the bistable spring device fails for some reason to complete the switching of the valving system from one of its positions to the other one. Should this condition occur, because of a jammed valve or some other mishap, the reciprocable member continues its movement in the same axial direction, thereby eventually causing actuation of the valving system to its other position. This feature of the invention preferably employs, but does not require a spool valve.

The spool valve is preferably constructed such that the valve body includes on its outer surface thereof a plurality of alternating annular lands and grooves, with the lands each including a sealing surface thereon, such as an o-ring. The valve body is slidable axially within a valve chamber, with alternating annular undercuts or grooves and lands being arranged on the inner wall surface defining the chamber. In both of the spool valve's operating positions, the valve body lands are sealingly engaged with corresponding lands on the valve chamber surface, and to move from one position to the other the valve body travels axially a distance equivalent to the distance between two adjacent valve chamber lands.

Preferably, the spool valve is hydraulically balanced without a substantial fluid pressure bias when in either of its first and second positions. Thus, the valve is held in each of its two operating positions only by virtue of a biasing force from the bistable spring device, which biases the valve body against a stop means until the initiation of valve switchover, as well as the friction generated by the sealing engagement between each o-ring and its corresponding valve chamber land. Consequently, a relatively low spring force is required to initiate movement of the spool valve between positions.

Yet another important feature of the invention is the annular undercuts or grooves between the valve chamber lands, which serve as fluid inlet and outlet ports for the spool valve, rather than the simple drilled bores which are typically used in the prior art. The significance of this feature is that the annular undercuts provide a substantially frictionless travel path for the o-rings between adjacent valve chamber lands. Thus, once motion of the valve body has been initiated, and the spring and frictional forces holding the valve body in place have been overcome, the valve body can more easily travel the axial distance to the other valve position.

The invention, together with additional features and advantages thereof, may best be understood by reference to the following description taken in connection with the accompanying illustrative drawing.

BRIEF DESCRIPTION OF THE DRAWING

FIG. 3 is an enlarged fragmentary sectional view similar to FIG. 1, showing the bistable spring device and the spool valve just after moving into their alternative positions responsive to the rightward movement of the reciprocable member;

FIG. 5 is an enlarged fragmentary sectional view similar to FIG. 1, showing the bistable spring device and the spool valve just after moving back to their first positions responsive to the leftward movement of the reciprocable member.

DESCRIPTION OF THE PREFERRED EMBODIMENT

Figure 1:
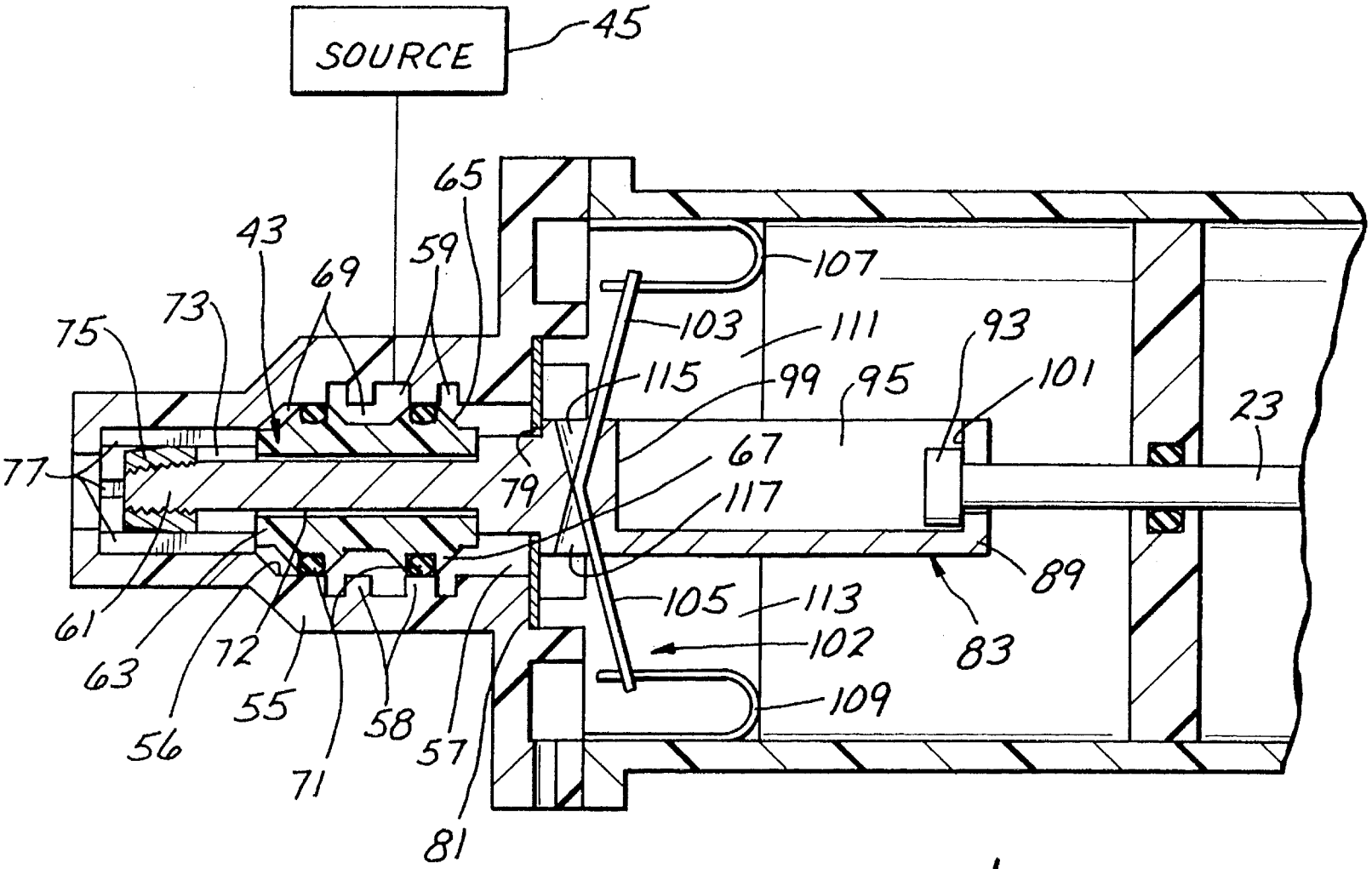
FIG. 1 is an enlarged fragmentary sectional view through a reciprocable device constructed in accordance with the teachings of this invention, showing details of a preferred form of spool valve and bistable spring device.

FIGS. 1 through 5 show a reciprocable device 11 (FIGS. 2 and 4) which includes a housing 13 defining a chamber or cylinder 15 in which a reciprocable member or piston 17 is slidably mounted for reciprocating movement. The piston 17 could also comprise a diaphragm, bellows, or the like. In the form shown in the drawing, the reciprocable device is a pump; however, the reciprocable device may be a compressor, meter or serve some other purpose. Although the piston 17 can be of different constructions, in the form illustrated, it includes piston sections 19 and 21 joined together by a shaft 23 and having driving faces 25 and 27 and pumping faces 29 and 31. With this arrangement, the chamber 15 is divided into driving chambers 33 and 35 at the opposite ends of the piston 17 and pumping chambers 37 and 39 between the piston sections 19 and 21 and a partition 41.

A spool valve 43 controls the supply of driving fluid under pressure from a supply source 45 to the driving chambers 33 and 35, and also controls the exhausting of the driving chambers 33 and 35 to atmosphere or other place of reduced pressure. By properly operating the spool valve 43 between at least a first and a second position, the piston 17 is reciprocated in the chamber 15.

Figure 2:
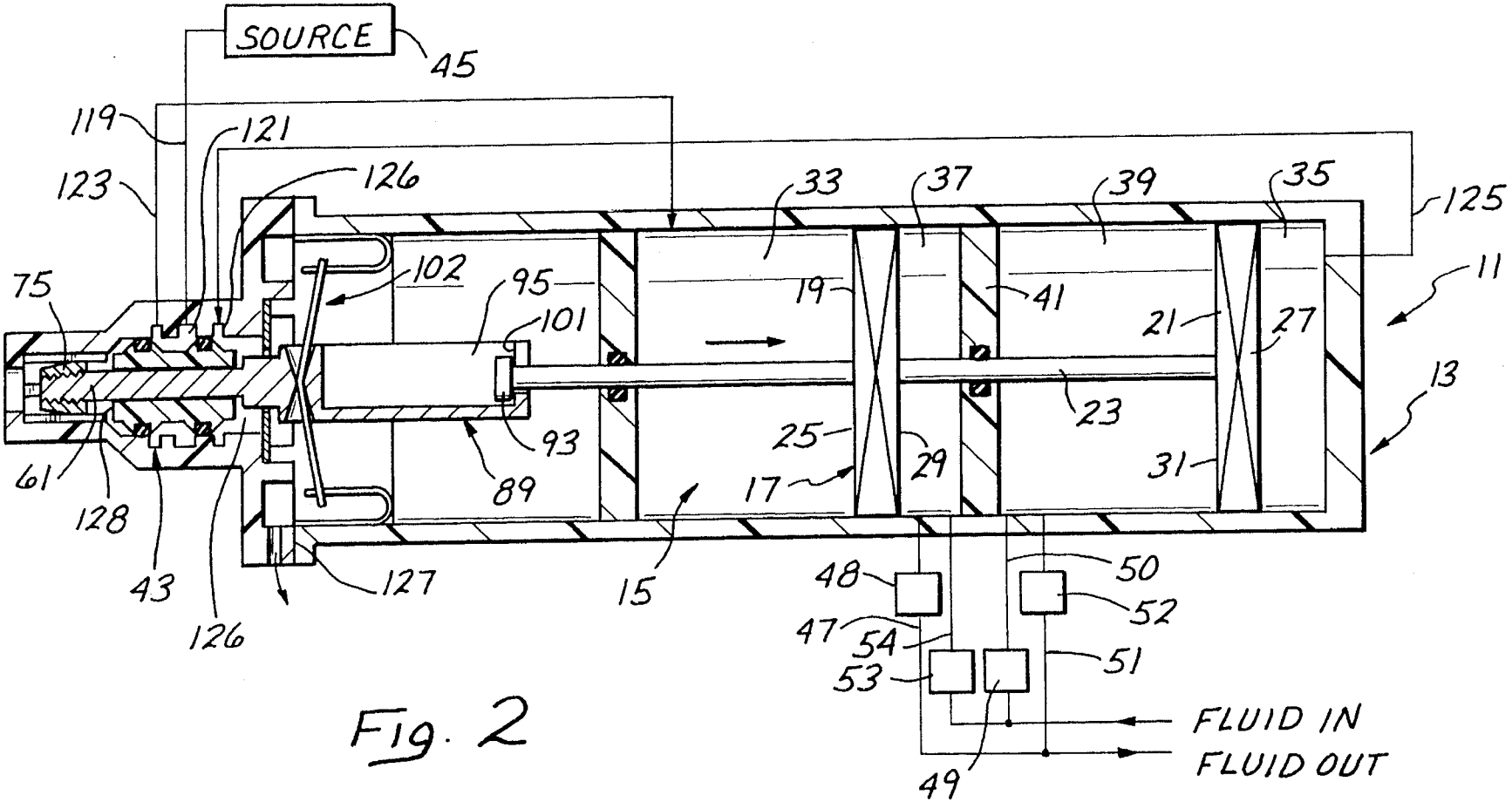
FIG. 2 is an axial sectional view of the reciprocable device illustrated in FIG. 1, showing the reciprocable member moving toward the right, and the bistable spring device about to pass through its neutral position.

As the piston 17 moves rightwardly, as shown in FIG. 2, fluid in the pumping chamber 37 is forced by the piston section 19 through an outlet line 47 and an outlet check valve 48 to a location where it is to be utilized, and fluid is drawn in through an inlet check valve 49 and an inlet line 50 into the pumping chamber 39. When the piston 17 reverses, the fluid in the pumping chamber 39 is forced by the piston section 21 through an outlet line 51 and an outlet check valve 52, and fluid is drawn in to the pumping chamber 37 through an inlet check valve 53 and an inlet line 54.

The spool valve 43 comprises a valve housing 55 (FIG. 1) having an inner wall surface 56 which defines a generally cylindrical valve chamber 57. The inner wall surface 56 of the valve housing 55 is comprised of a series of alternating annular lands 58 and annular undercuts or grooves 59. Slidably mounted axially about a rod or an actuator 61 within the valve chamber 57 is a spool valve body 63 which has an exterior surface 65 formed of an alternating series of annular lands 67 and grooves 69. Retained in channels on the valve body lands 67 are a plurality of o-rings 71, which are oriented so that when the valve body 63 is stopped in a position wherein the valve housing lands 58 and the valve body lands 67 are aligned, each land 58 is in sealing engagement with a respective o-ring 71. The rod 61 and the valve body 63 are spaced by an annular gap 72, so that the rod 61 may move axially independently of the valve body 63. The rod 61 extends leftwardly out of the valve chamber 57 into a driving fluid exhaust plenum 73. On the leftmost end of the rod 61 is threadedly mounted a bumper nut 75 which is guided axially within the plenum 73 by a plurality of stop ribs 77 mounted longitudinally on the surface defining the plenum 73.

The spool valve rod 61 also extends rightwardly out of the valve chamber 57 through an opening 79 in an end plate 81. This rod extension portion 83 includes a pair of stepped diameter increases 85 and 87 (FIG. 3) culminating in a large diameter coupling portion 89. The coupling portion 89 of the rod extension portion 83 is attached to the leftmost end or attachment portion 93 of the piston shaft 23, in such a manner as to ensure that there is lost motion between the two elements. In the preferred embodiment, the attachment portion 93 of the shaft 23 has a greater diameter than the remainder of the shaft and is received within a lost motion chamber 95 in the coupling portion 89 of the rod 61. When the piston 17 is reciprocated in one of its two directions, the attachment portion 93 of the shaft 23 moves axially within the chamber 95 until it contacts one of two chamber walls 99 and 101, after which, by virtue of the contact between the coupling portion 89 and the attachment portion 93, the coupling portion 89 is either pushed or pulled to reciprocate in response to the reciprocation of the piston 17.

In the preferred embodiment, the reciprocable device 11 includes a bistable spring device 102, comprising identical rigid levers 103 and 105, which may be constructed of stainless steel, and identical U-shaped springs 107 and 109 which are mounted within respective chambers 111 and 113. The levers 103 and 105 have tabs (not shown) on the outer ends thereof, which are received by openings (not shown) in the U-shaped springs 107 and 109, thereby attaching the levers 103 and 105 to the springs 107 and 109 so that the levers are biased towards the coupling portion 89. Such an attachment scheme is shown and disclosed in U.S. Pat. No. 4,610,192, herein incorporated by reference. Of course, other well known prior art attachment methods may be utilized equally well without compromising the efficacy of the claimed invention. The springs 107 and 109 may be integrated into one spring, interconnected by a web such as that shown in the U.S. Pat. No. 4,610,192, or may be distinct spring elements, as shown. The coupling portion 89 has recesses 115 and 117 which progressively widen as they extend radially toward the periphery of the coupling portion 89 and this allows each of the levers to pivot about a pivot axis at the inner end of the associated recess. Because the levers 103 and 105 are biased toward the coupling portion 89, it forms pivot axes for the levers by virtue of the progressively widening nature of each of the recesses 115 and 117.

Now with reference to the operation of the device, in the position shown in FIG. 2, the spool valve body 63 is seated against the stop ribs 77 and held in position by the spring device 102. Driving fluid under pressure is supplied from the supply source 45 through a fluid line 119 into an annular chamber portion 121 of the spool valve 43. The spool valve body 63 is in a first position at this juncture, permitting the fluid to exit the chamber portion 121 via a fluid line 123 which communicates with the driving chamber 33. The influx of pressurized driving fluid into the driving chamber 33 drives the piston 17 to the right, thereby causing pressurized pumping fluid to exit pumping chamber 37 through exhaust line 47 and driving fluid to be exhausted from driving chamber 35 through an exhaust line 125 which communicates with an annular chamber portion 126 of the spool valve 43. From the annular chamber portion 126, the exhaust fluid flows through an exhaust passage 127 to atmosphere, a waste sump, or some other low pressure application. With regard to the bistable spring device 102, it is apparent that the movement of the piston 17 to the right moves the attachment portion 93 to the right through the chamber 95, until it impacts the end wall 101 of the coupling portion 89. This impact pulls the coupling portion 89 to the right, thereby pulling the spool valve rod 61 and the bumper 75 mounted thereon to the right as well. The movement of the coupling portion 89 to the right also causes the levers 103 and 105 to pivot from a first position wherein they are pivoted to the left, as shown in FIG. 1, through a neutral position to the position shown in FIG. 3.

FIG. 3 shows the device with the piston 17 beginning its leftward travel, and the spool valve body 63 having been translated into its second axial position. In operation, as the levers 103 and 105 are pivoted by the movement of the coupling portion 89 into their neutral position and over center, the resilience of the springs 107 and 109 rapidly forces the levers farther over center and into their second position, pivoted to the right. This rapid movement of the levers 103 and 105 becomes stronger as the levers travel farther past the over center point, pushing the coupling portion 89 and the associated rod 61 equally rapidly to the right, thereby initiating movement of the spool valve body to its second axial position by virtue of a small impact of the bumper 75 on the spool valve body 63. Essentially, the exhaust chamber 73 acts as another lost motion device, ensuring in conjunction with the lost motion chamber 95 that the spool valve 43 is not actuated to its alternate position until the piston 17 has traveled a sufficient stroke distance.

An important aspect of the invention is that the spring biased levers 103 and 105 are arranged to form an over center device, in order to provide the impetus necessary to move the spool valve 43 from one to another of its two positions. However, on occasion there may be a need for a mechanical backup to ensure the proper operation of the over center device. If for any reason switchover is not initially achieved by the bistable spring device 102, an advantage of the instant invention over the prior art is that the piston itself provides a backup means for ensuring that the bistable spring device 102 is able to switch the valve to its alternate position. Referring again to FIG. 2, should the spring device 102, moving from its neutral position to its over center position as disclosed above, fail to initiate movement of the valve 43 from its first to its second position, the piston 17 will continue to move toward the right, with the attachment portion 93 of the piston shaft 23 pulling the coupling portion 89 and the associated spool valve rod 61 to the right as well. Once the bumper 75 impacts the left side 128 of the valve body 63, the valve body will be forced to slide rightward axially, allowing it to pass the sealing land 58, into the frictionless undercut area, or switching zone, 59. This allows the stored energy of the bistable spring 102 to accelerate the valve body 63 in a frictionless environment towards the other sealing position. Once the valve 43 has been switched, the driving fluid flowpath changes and the piston 17 reverses direction, as will be described more fully below.

Figure 4:
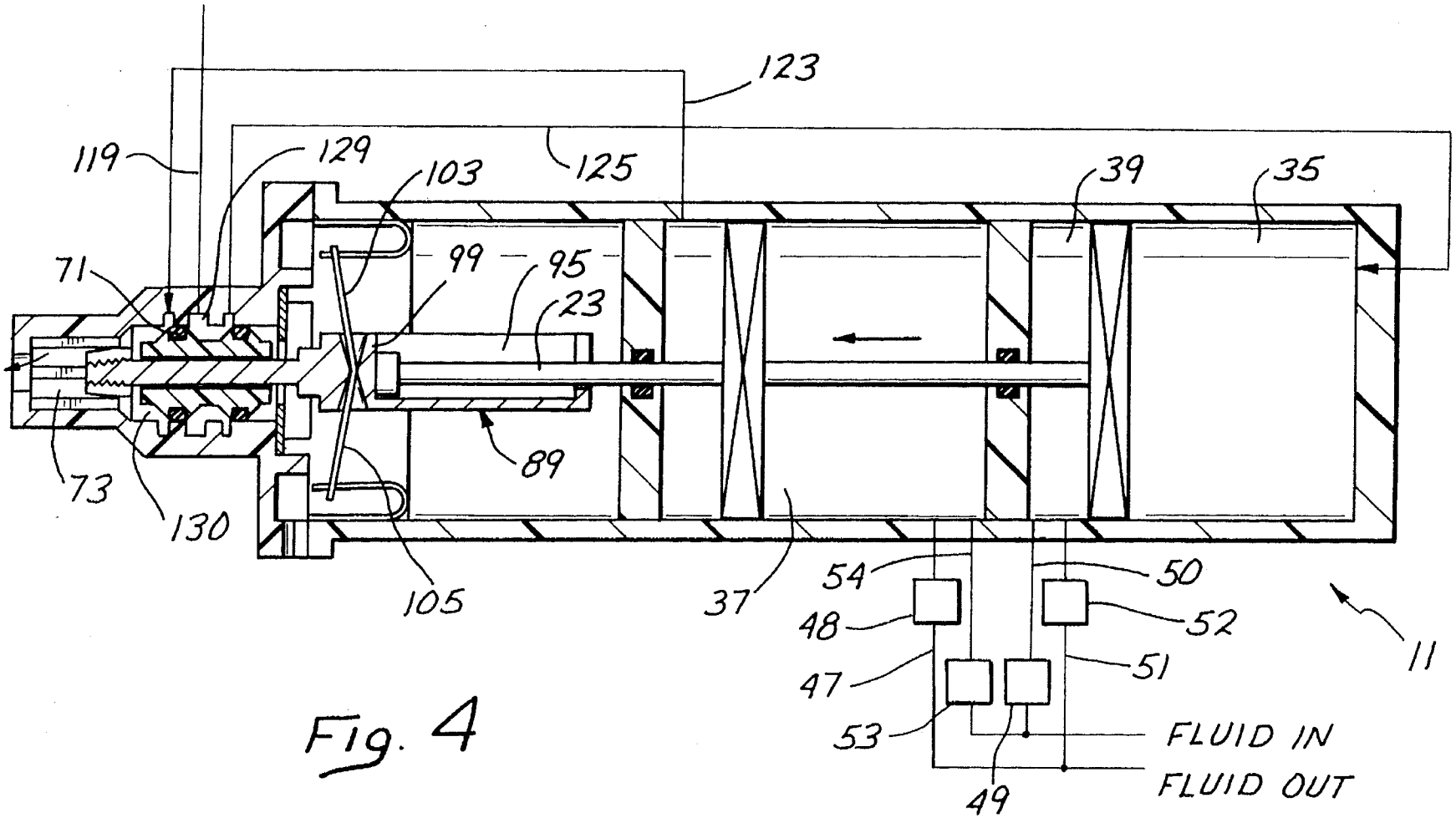
FIG. 4 is an axial sectional view similar to FIG. 2, showing the reciprocable member moving toward the left.

The movement of the valve body 63 from its first position, shown in FIG. 2, to its second position, shown in FIG. 3, constitutes a movement of each of the lands 67 of the valve body 63 a total axial distance equal to the distance between valve chamber lands 58, so that each o-ring 71 aligns in sealing engagement with the land 58 adjacent to the land 58 with which it was previously aligned. Referring now particularly to FIG. 4, the reciprocable device 11 is shown with the valve 43 in its second position. Consequently, because of the repositioned o-rings 71, the pressurized driving fluid from the supply line 119 is delivered into a different annular chamber portion 129. The flow line 123 into the driving chamber 33 is now shut off from the supply line 119 by an intervening o-ring 71, and the fluid is now redirected into the fluid line 125 which communicates with the other driving chamber 35. The influx of pressurized driving fluid into the driving chamber 35 reverses the travel direction of the piston, driving it to the left, thereby causing pressurized pumping fluid to exit pumping chamber 39 through exhaust line 51 and driving fluid to be exhausted from the driving chamber 33 through the fluid line 123. The fluid line 123 communicates with the exhaust plenum 73 through an annular chamber portion 130 of the spool valve 43, as shown. With regard to the bistable spring device 102, the movement of the piston 17 back to the left moves the attachment portion 93 to the left through the chamber 95, until it impacts the end wall 99 of the coupling portion 89. This impact begins to push the coupling portion 89 to the left, thereby pivoting the levers 103 and 105 through their neutral position, and also pushing the spool valve rod 61 to the left as shown in FIG. 5.

As the levers 103 and 105 are pivoted by the movement of the coupling portion 89 into their neutral position and over center, the resilience of the springs 107 and 109 rapidly forces the levers further over center and into their first position, pivoted to the left, as shown in FIG. 5. This rapid movement of the levers 103 and 105 pushes the coupling portion 89 and the associated rod 61 equally rapidly to the left, the rod 61 and the bumper 75 traveling axially through the valve chamber 57 and the exhaust plenum 73, respectively, until the first stepped portion 85 of the coupling portion 89 passes through the opening 79 and impacts the right end wall 131 of the valve body 63. This leftward motion of the coupling portion 89 may continue until the second stepped portion 87 abuts the wall 133 in which the opening 79 is located.

The impact of the first stepped portion 85 on the wall 131 of the valve body 63 initiates movement of the valve body 63 from its second axial position back to its first position, abutting the stop ribs 77. Once the valve 43 has been switched, the driving fluid flowpath changes, with the driving fluid again flowing through fluid line 123 into the driving chamber 33, as shown in FIG. 2. Consequently, the piston 17 again reverses direction and a new cycle begins. FIG. 5 shows the attachment portion 93 of the piston shaft 23 beginning its rightward motion again as a result of the valve switchover, it having already moved rightwardly away from abutting contact with the end wall 99.

As discussed with respect to FIG. 3, the spring biased levers 103 and 105 provide the impetus necessary to move the spool valve 43 from one to another of its two positions. However, again in the FIG. 4 configuration, with the piston 17 nearing the end of its leftward travel, in the event that the spring device 102 is unable for some reason to initiate the valve switchover, the piston provides a mechanical backup to ensure that the switchover occurs. Should the spring device 102, moving from its neutral position to its over center position as disclosed above, fail to complete movement of the valve 43 from its second to its first position, because of a valve jam or the like, the piston 17 will continue to move toward the left. Consequently, the attachment portion 93 of the piston shaft 23 pushes the coupling portion 89 and the associated spool valve rod 61 to the left as well. Once the stepped portion 85 impacts the right side 131 of the valve body 63, the valve body will be forced to slide leftward axially, thereby pushing the valve body 63 toward the frictionless undercut, or switching zone, 59. This will allow the stored spring energy to be released, which will accelerate the valve body towards its second position. Once the valve 43 has been switched, the driving fluid flowpath changes and the piston 17 again reverses direction, as discussed above.

Yet another key aspect of this invention is the advantageous configuration of the spool valve 43 in that it is hydraulically balanced. In the prior art systems, which use poppet valves to switch the piston travel direction, the valves are biased by the fluid pressure in the system, requiring a larger bistable spring force to overcome the fluid pressure bias in order to switch the valves. Thus, for high pressure applications, a strong spring must be used to assure switching of the valves. This relatively high spring force holds the reciprocable member in either of two positions even when the device is not in use, and as a consequence, the seating surfaces of the valves tend to take an undesirable permanent set. However, in the inventive system, the spool valve 43 is designed to be held in either of its positions merely by virtue of the relatively small spring force created by the bistable spring, which holds the valve body 63 in position prior to initiation of valve switching, in order to eliminate the possibility of unintentional switching. The friction developed by the sealing engagement between the o-rings 71 and their corresponding lands 58 also serves as a secondary means for holding the valve body in position. Thus, the bistable spring 102 need only overcome this frictional force to initiate movement of the valve body 63 from one position to another, permitting the use of a less powerful spring.

An additional advantage of the present invention, further reducing the force and the duration of the force necessary to switch the valve, is the use of the fully annular grooves or undercuts 59 to provide the inlet and outlet fluid flow passages for the spool valve 43, rather than simple drilled bores that are typically used in the prior art. The advantage of the annular undercuts is that as the valve body 63 travels axially from one of its positions to the other one, each of the o-rings 71 moving from one land 58 to the next, the o-rings encounter no friction as they travel over the annular undercuts. Therefore, once a sufficient force has been applied to the valve body 63 to initiate motion thereof, overcoming the friction due to the sealing engagement between each of the o-rings 71 and its corresponding land 58, the valve body will have sufficient momentum, from the acceleration caused by the release of energy from the bistable spring, to travel an axial distance equivalent to the distance between lands 58, and thus sufficient to move into its other position. The frictionless travel of the o-rings across the undercuts 59 will not degrade that momentum.

Various other features and advantages of the present invention will occur to those having skill in the art. For example, a spool valve is a versatile valve in that it may control the flow of a number of different fluids and fluids of different pressures simultaneously. Consequently, the inventive system may be utilized in more complex and interdependent fluid flow systems than is possible using a prior art system.

Although an exemplary embodiment of the invention has been shown and described, many changes, modifications and substitutions may be made by one having ordinary skill in the art without necessarily departing from the spirit and scope of this invention.

What is claimed:

1. A reciprocable device comprising:

a housing having a chamber therein;

a reciprocable member in the chamber and having first and second faces exposable to a driving fluid under pressure to reciprocate the reciprocable member in the chamber;

a valve having first and second states for controlling the supply and exhaust of the driving fluid under pressure to and from the first and second faces whereby the reciprocable member can be reciprocated in said chamber;

an actuator for drivingly coupling the reciprocable member and the valve;

a bistable spring device having first and second states and a neutral position between said states thereof;

said bistable spring device being coupled to said actuator such that said reciprocable member can move the bistable spring device from one of its states through the neutral position, with the resilience of the bistable spring device at least assisting in moving the bistable spring device from its neutral position to the other state thereof, movement of said bistable spring device to said other state at least assisting in switching the valve from one of its states to another so that the reciprocable member reverses direction; and wherein if said bistable spring device is initially unable to exert sufficient force to switch the valve said reciprocable member continues its movement in the same direction to drive the actuator and cause the actuator to directly drive the valve to initiate movement of the valve to its alternate state.

2. A reciprocable device as recited in claim 1, wherein said reciprocable device comprises a pump, said reciprocable member comprising a pair of piston sections joined together by a piston shaft, a partition dividing a chamber defined by said pair of piston sections and forming first and second chambers thereby, one of said first and second chambers being located between an inner face of each said piston section and the partition, third and fourth chambers being located adjacent an outer face of each said piston section, wherein one of said inner and outer faces for each of the piston sections comprises one of said driving fluid faces and the other of said inner and outer faces comprises a pumping fluid face, such that two of said first, second, third, and fourth chambers comprise said driving chambers and the other two comprise said pumping chambers, whereby when pressurized driving fluid is introduced into one of said first and second driving chambers, the resultant expansion of said driving chamber compresses the corresponding pumping chamber, thereby pressurizing pumping fluid contained therein and forcing said fluid to exit through a pumping fluid exit line.

3. A reciprocable device as recited in claim 1, wherein the valve includes a spool valve movable between said first and second states for controlling the supply and exhaust of the driving fluid under pressure to and from the first and second faces.

4. A reciprocable device as recited in claim 1 wherein the actuator extends through the valve body and includes portions engageable with opposite ends of the valve body.

5. A reciprocable device as recited in claim 1 wherein the valve includes a valve housing having an interior wall surface defining a valve chamber and a valve body slidably mounted within the valve chamber for movement between first and second positions which correspond to the first and second states of the valve, respectively, said interior wall surface has first and second spaced lands thereon and an undercut annular groove between the first and second lands, said valve body having a sealing surface, said sealing surface traveling from sealing engagement with one of the lands of the valve chamber across the undercut annular groove to another of the lands of the valve chamber as the valve body moves from one of the positions to the other of the positions.

6. A reciprocable device as recited in claim 5 wherein there are a plurality of said lands and undercut annular grooves with one of said undercut annular grooves being between each pair of said lands.

7. A reciprocable device as recited in claim 1 wherein said valve includes a valve housing having an interior wall surface defining a valve chamber and a valve body slidably mounted within the valve chamber for movement between first and second positions which correspond to the first and second states of the valve, respectively.

8. A reciprocable device as recited in claim 7 wherein said valve body is balanced without an effective fluid pressure bias when in either of the first and second positions.

9. A reciprocable member as recited in claim 1, and wherein said bistable spring device comprises first and second levers, inner end portions of which are received by first and second recesses in said actuator, respectively, and a spring for urging the first and second levers into the first and second recesses, respectively, of the actuator.

10. A reciprocable member as recited in claim 9, wherein said reciprocable member has a shaft attached thereto which extends toward and interconnects with said actuator, said interconnection being made with some lost motion, such that reciprocation of the reciprocating member through a distance near the end of a stroke exceeding a predetermined distance equal to the lost motion in the interconnection actuates said bistable spring device from one of its states through the neutral position toward the other state thereof, thereby at least assisting in driving the valve from one of its two states to the other one thereof.

11. A reciprocable device as recited in claim 10, wherein said actuator includes a lost motion chamber therein for providing said lost motion interconnection, said piston shaft having an attachment portion on the end thereof, said attachment portion being received by said lost motion chamber such that the piston shaft and the actuator are interconnected, and being slidable within said last motion chamber, whereby when said piston reciprocates in a predetermined direction the attachment portion reciprocates in the same direction within said lost motion chamber.

12. A reciprocable device comprising:

a housing having a chamber therein;

a reciprocable member in the chamber and having first and second faces exposable to a driving fluid under pressure to reciprocate the reciprocable member in the chamber;

a valve having first and second states for controlling the supply and exhaust of the driving fluid under pressure to and from the first and second faces whereby the reciprocable member can be reciprocated in said chamber;

an actuator for drivingly coupling the reciprocable member and the valve;

a bistable spring device having first and second states and a neutral position between said states thereof;

said bistable spring device being coupled to said actuator such that said reciprocable member can move the bistable spring device from one of its states through the neutral position, with the resilience of the bistable spring device at least assisting in moving the bistable spring device from its neutral position to the other state thereof, movement of said bistable spring device to said other state at least assisting in switching the valve from one of its states to another so that the reciprocable member reverses direction;

said valve including a valve housing having an interior wall surface defining a valve chamber and a spool valve body slidably mounted within the valve chamber for movement between first and second positions which correspond to the first and second states of the valve, respectively; and said interior wall surface having first and second spaced lands thereon and an undercut annular groove between the first and second lands, said valve body having a sealing surface, said sealing surface traveling from sealing engagement with one of the lands of the valve chamber across the undercut annular groove to another of the lands of the valve chamber as the valve body moves from one of the positions to the other of the positions.

13. A reciprocable device as recited in claim 12 wherein there are a plurality of said lands and undercut annular grooves with one of said undercut annular grooves being between each pair of said lands.

14. A reciprocable device as recited in claim 12 wherein said valve body is balanced without an effective fluid pressure bias when in either of the first and second positions.

15. A reciprocable device as recited in claim 12 wherein the sealing surface on the valve body includes an O-ring.

16. A reciprocable device as recited in claim 12 wherein said spool valve body is balanced without a substantial fluid pressure bias when in either of the first and second positions, the bistable spring device combined with friction between the sealing surface and the valve chamber lands being sufficient to hold the spool valve body in position.

17. A reciprocable device as recited in claim 12 wherein said bistable spring device comprises first and second levers, inner end portions of which are received by first and second recesses in said actuator, respectively, and a spring for urging the first and second levers into the first and second recesses, respectively.

* * * * *